US010508377B2

(12) United States Patent
Hodgell

(10) Patent No.: US 10,508,377 B2
(45) Date of Patent: Dec. 17, 2019

(54) LAUNDRY TREATING APPLIANCE WITH AN ADJUSTABLE HEIGHT LIFTER

(71) Applicant: WHIRLPOOL CORPORATION, Benton Harbor, MI (US)

(72) Inventor: James Hodgell, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 294 days.

(21) Appl. No.: 15/299,957

(22) Filed: Oct. 21, 2016

(65) Prior Publication Data

US 2018/0112342 A1 Apr. 26, 2018

(51) Int. Cl.
*D06F 37/06* (2006.01)
*D06F 58/04* (2006.01)

(52) U.S. Cl.
CPC ..... *D06F 37/06* (2013.01); *D06F 58/04* (2013.01)

(58) Field of Classification Search
None
See application file for complete search history.

(56) References Cited

U.S. PATENT DOCUMENTS

| | | | | |
|---|---|---|---|---|
| 9,487,907 | B2 * | 11/2016 | Hapke | D06F 39/14 |
| 2004/0118168 | A1 | 6/2004 | Woo et al. | |
| 2005/0022565 | A1 | 2/2005 | Jung et al. | |

FOREIGN PATENT DOCUMENTS

| | | | |
|---|---|---|---|
| EP | 2053152 | A1 | 4/2009 |
| EP | 2280108 | A1 | 2/2011 |
| JP | S5670793 | A | 6/1981 |
| JP | H0433689 | A | 2/1992 |
| KR | 20050082930 | A | 8/2005 |
| KR | 100701174 | B1 | 3/2007 |

OTHER PUBLICATIONS

European Search Report for Counterpart EP17197549.3, dated Mar. 2, 2018.

* cited by examiner

*Primary Examiner* — Rita P Adhlakha
(74) *Attorney, Agent, or Firm* — McGarry Bair PC

(57) ABSTRACT

A laundry treating appliance having a rotating drum with one or more lifters extending from an inner surface of the drum. The one or more lifters are adjustable in height relative to the inner surface of the drum. The lifter can have an adjustable element that is movable between at least two positions to vary the height the lifter extends from the inner surface.

20 Claims, 5 Drawing Sheets

LAUNDRY TREATING APPLIANCE WITH AN ADJUSTABLE HEIGHT LIFTER

BACKGROUND

A horizontal axis washing machine typically has a rotatable drum that rotates about a generally horizontal axis and defines a treating chamber for receiving the laundry. A plurality of lifters can be disposed on an inner surface of the drum to lift the laundry load received in the treating chamber while the drum rotates. The lifter design imparts mechanical energy to the laundry primarily by lifting/dropping the laundry items as the drum is rotated. The mechanical energy is used to clean the laundry items during a wash cycle.

BRIEF SUMMARY

One aspect of the invention relates to a laundry treating appliance comprising a drum having an inner surface at least partially defining a treating chamber and an end with an opening to define an access opening to the treating chamber. A lifter extending from the inner surface inwardly into the treating chamber and having an adjustable element movably mounted to the lifter between first and second positions and having first and second profiles. When the adjustable element is in the first position, the first profile provides the lifter with a first effective height, and when the adjustable element is in the second position, the second profile provides the lifter with a second effective height, which is less than the first effective height.

DETAILED DESCRIPTION

Figure 1:
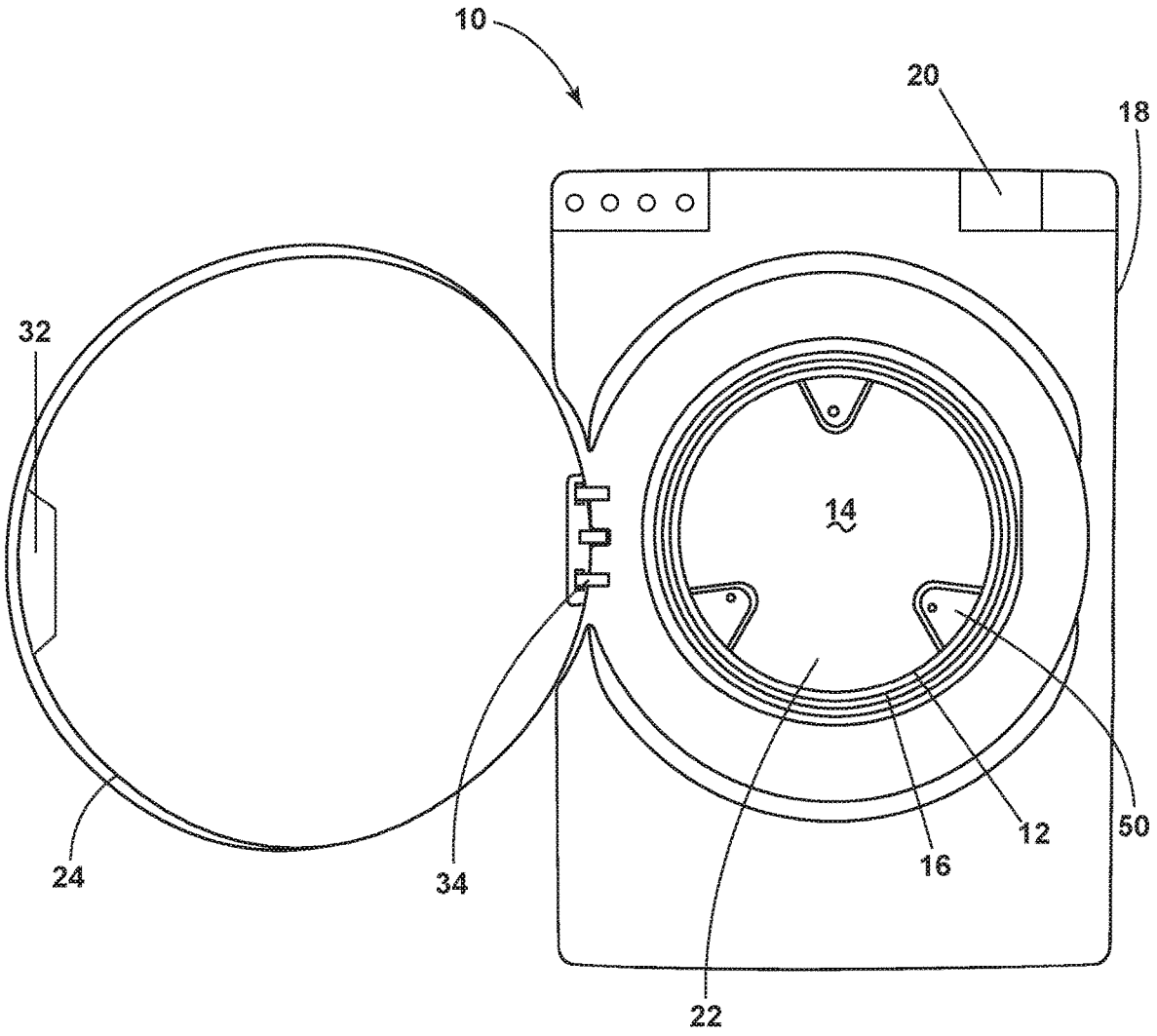
FIG. 1 is a front view of a horizontal axis laundry treating appliance incorporating aspects of the invention, with a door of the laundry treating appliance shown in an open position to better see lifters within a drum.

FIG. 1 shows a laundry treating appliance in accordance with the present disclosure, which happens to be a horizontal axis automatic clothes washing machine 10. Although much of the remainder of this application will focus on the embodiment of the horizontal axis automatic clothes washing machine 10, the present disclosure encompasses other environments, including other horizontal axis laundry treating appliances such as a laundry dryer. Also, while illustrated as a front-loading, horizontal axis laundry treating appliance, other loading configurations, such as top-loading are contemplated.

Further, other axes of rotation are contemplated. A vertical axis laundry treating appliance is contemplated in addition to the illustrated horizontal axis laundry treating appliance. For purposes of this description, the terms horizontal axis and vertical axis are used to represent the general orientation of the axis of rotation and is not meant to be limited to a perfectly horizontal or vertical axis of rotation. More accurately, the terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum. That is, rotation of the drum lifts and then drops the laundry. This lifting/dropping imparts mechanical energy to the laundry. The vertical axis washing machine imparts mechanical energy via a clothes mover, such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

The washing machine 10 shares many features of a conventional automated clothes washer, which will not be described in detail herein except as necessary for a complete understanding of the illustrative embodiments in accordance with the present disclosure. Examples of articles include, but are not limited to, a hat, a scarf, a glove, a sweater, a blouse, a shirt, a pair of shorts, a dress, a sock, and a pair of pants, a shoe, an undergarment, and a jacket. One or more articles form a laundry load.

The washing machine comprises a cabinet 18 that defines an interior. The cabinet 18 can be a housing having a chassis and/or a frame, defining the interior, enclosing components typically found in a conventional washing machine, such as motors, pumps, fluid lines, controls, sensors, transducers, and the like. Such components will not be described further herein except as necessary for a complete understanding of the disclosure.

A tub 16 is located within the interior of the cabinet 18 and defines a liquid-holding chamber in which liquid for the treating cycle is held during operation. A drum 12 is located within the tub 16 and can be rotatably mounted to the tub 16 or the cabinet 18. A suspension system (not shown) suspends at least one of the tub 16 and drum 12 relative to the cabinet 18.

The drum 12 defines a treating chamber 14 for receiving the laundry and rotates about a generally horizontal axis. The drum 12 can include a plurality of perforations (not shown) such that liquid can flow between the tub 16 and the drum 12 through the perforations.

A door 24 can be movably mounted to the cabinet 18 to selectively close an opening 22 to the treating chamber 14. The door 24 can have a handle 32 for pivotally opening the door about a hinge 34.

The washing machine 10 can also be provided with a dispenser 20 for dispensing treating chemistry to the treating chamber 14 for use in treating the laundry according to a cycle of operation. Non-limiting examples of treating chemistries that can be dispensed by the dispenser 20 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

At least one or more lifters 50 can be provided within the drum 12. The lifters 50 can extend from an inner surface of the drum and are typically, but not necessarily, equally spaced about the inner surface of the drum 12. The lifters 50 can be configured as a separate member to be installed in the drum 12 or integrally made with the drum 12. The lifter 50 may extend in parallel with a central axis of the drum 12. The lifter 50 is preferably formed of a material that is resistant against corrosion and abrasion due to water and chemical detergent. The lifter 50 can be coated with antimicrobial coatings with anti-staining properties to protect the surface and laundry articles from microbial contamination after continuous use. The lifter 50 is adjustable to extend at varying heights relative to the drum 12.

Figure 2A:
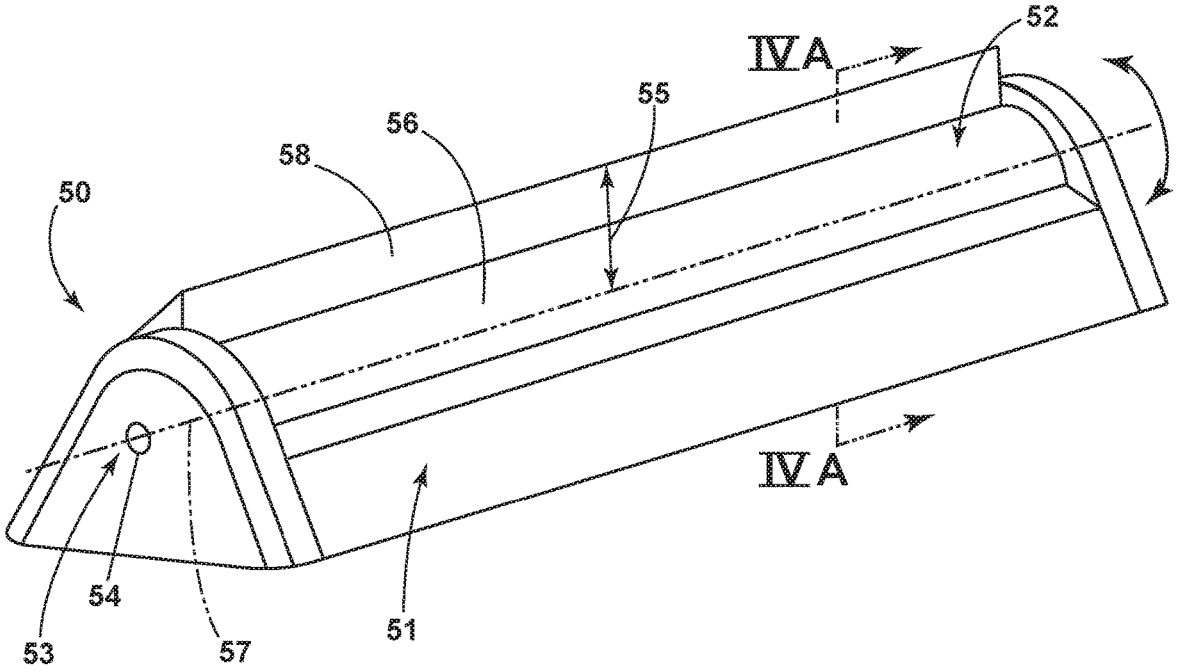
FIG. 2A is a perspective view of a lifter in a first height position, which happens to be an extended height.
Figure 2B:
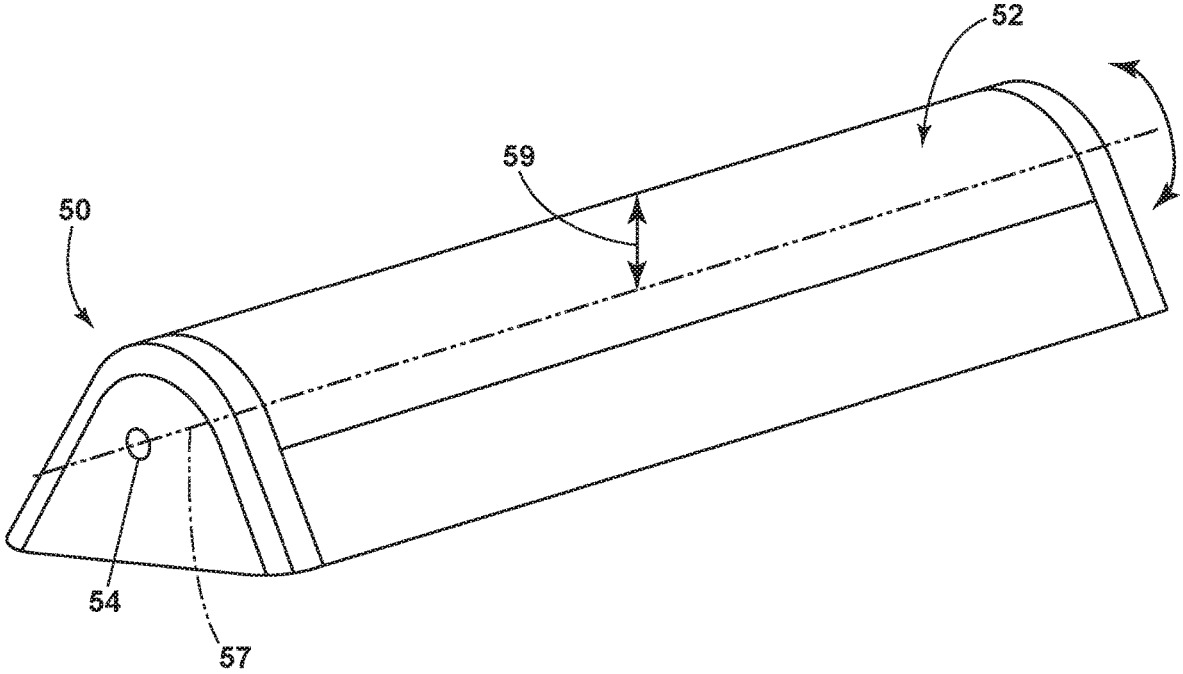
FIG. 2B is a perspective view of the lifter in FIG. 2A in a second position, which happens to be a reduced height.

The varying height of one of the lifters 50, is best seen with respect to FIG. 2A, which shows the lifter 50 at a maximum height and FIG. 2B, which shows the lifter 50 at a minimum height. It is contemplated that the lifter 50 can be fixedly positioned at any location between the maximum and minimum height positions, including the maximum and minimum heights. For purposes of simplicity only two such positions, first and second positions, will be described and correspond to the maximum and minimum heights, with it being understood many more positions/heights are contemplated.

Referring to FIG. 2A, the lifter 50 includes a housing 51 to which is moveably mounted an adjustable element 52. While any type of movable mounting is contemplated, the adjustable element 52 is illustrated as being rotatably mounted to the housing 51 for rotation about a rotation axis 57.

The lifter 50 further comprises a lock 53 fixing the position of the adjustable element 52 in at least one of the first and second positions. The lock 53 comprises an actuator 54, which can be conveniently located on a portion of the lifter 50 facing the access opening 22 of the treating chamber 14. The lock 53 can be in the form of a conventional detent mechanism to prevent unexpected rotary movement of the adjustable element in the first and second positions. Any other type of known lock can be used.

Figure 3A:
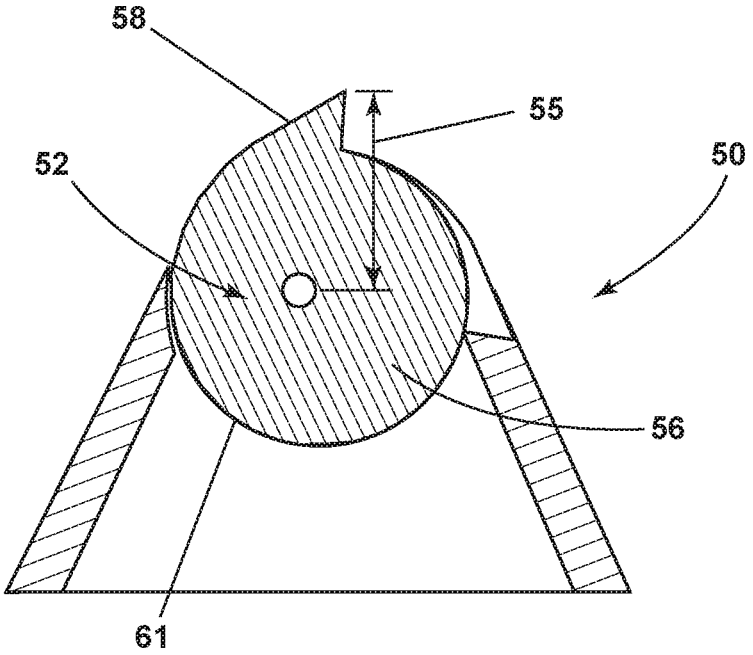
FIG. 3A is a cross-sectional view of the lifter in FIG. 2A in the first position.
Figure 3B:
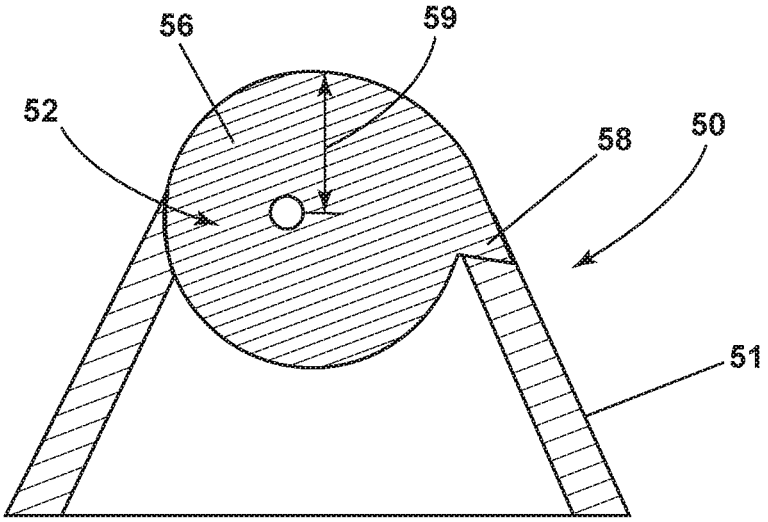
FIG. 3B is a cross-sectional view of the lifter in FIG. 2B in the second position.

Referring to FIG. 3A, the adjustable element 52 comprises a main body 56 and a ridge 58 projecting from the main body 56. The adjustable element 52 has an asymmetrical body 61 wherein the asymmetrical body 61 comprises a maximum projection 55 from the drum 12, which corresponds to the ridge 58 being rotated to the first position, which defines the first effective height. As shown in FIG. 3B, a lesser projection 59 of the asymmetrical body 61 relative to the drum 12 occurs when the ridge 58 is rotated to the second position, with the projection 59 defining a second height in the second position that is less than the first height in the first position.

Still referring to FIG. 3B, conveniently, the shape of the body 56, including the ridge 58, is such that the adjustable element is complementary in shape to the lifter housing 51 in the second position. The complementary shapes provide for a flush receipt of the ridge 58 with the housing 51 in the second position to prevent the ridge 58 from inadvertently catching laundry items in the second position. Thus, the first position for the adjustable element 52 can be thought of as a use position and the second position can be thought of as a stored position.

Figure 4A:
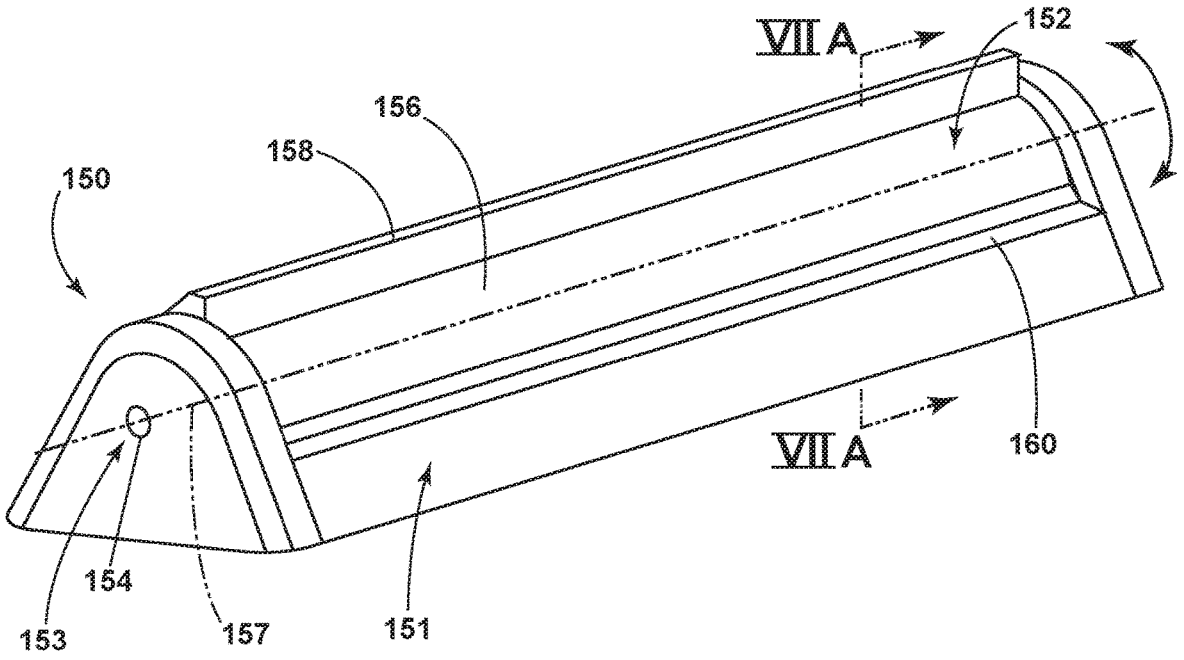
FIG. 4A is a perspective view of a second embodiment of the invention, in which a lifter is in the first position.

A second embodiment of the lifter 150 is illustrated in FIG. 4A. The second embodiment is similar to the first embodiment, with it being understood that the description of the like parts of the first embodiment applies to the additional embodiments, unless otherwise noted. Thus, numerals for elements of the second embodiment similar to the first embodiment will be increased by 100.

Figure 4B:
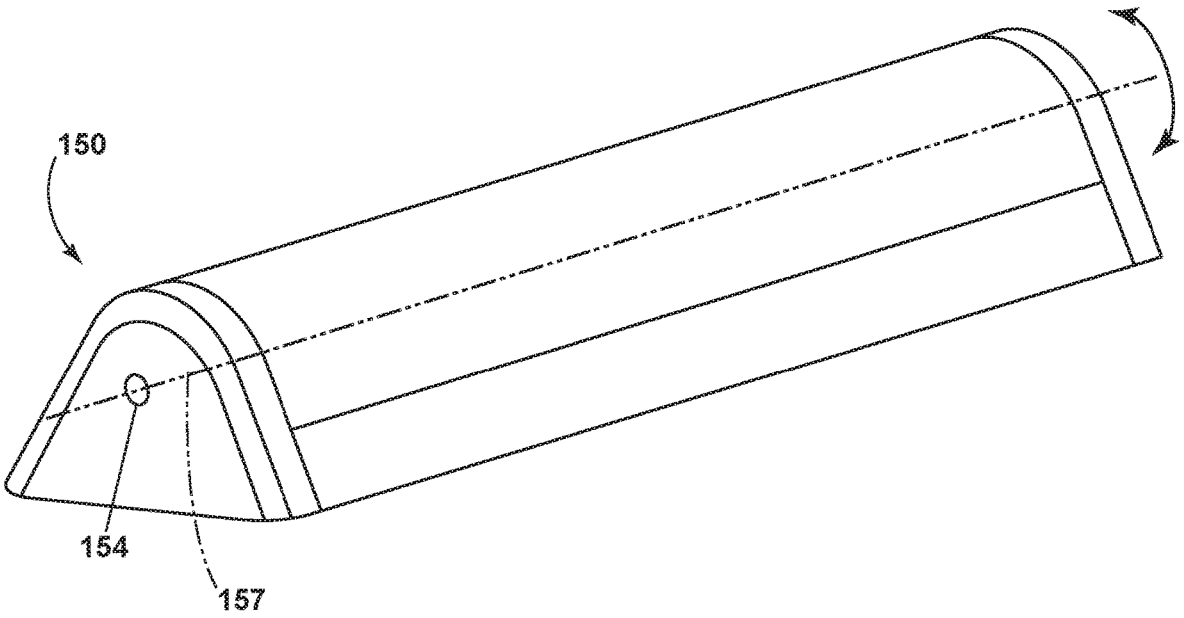
FIG. 4B is a perspective view of the lifter in FIG. 4A in the second position.

The second embodiment of the lifter 150 is similar to the first embodiment 50, in that it comprises an adjustable element 152 rotatable about a rotation axis 157 and a locking mechanism 153 with an actuator 154. The adjustable element 152 is rotatably mounted to the lifter housing 151 and rotates between the first and second positions having first and second effective height as shown in FIGS. 4A and 4B respectively. The lifter 150 differs in that the ridge 158 projected from the main body 156 of the adjustable element 152 is shown as having a rectangular profile. The lifter 150 also differs in that the ridge 158 can be received within an interior compartment 160 of the lifter 150 when the adjustable element 152 is in the second position.

Figure 5A:
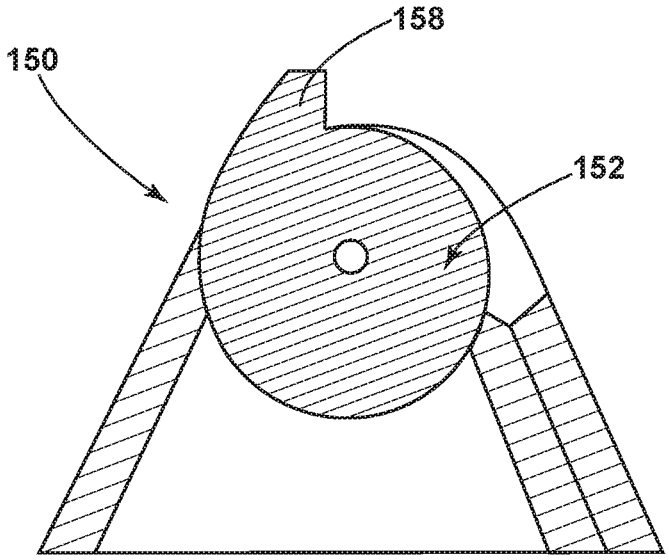
FIG. 5A is a cross-sectional view of the lifter in FIG. 4A in the first position.
Figure 5B:
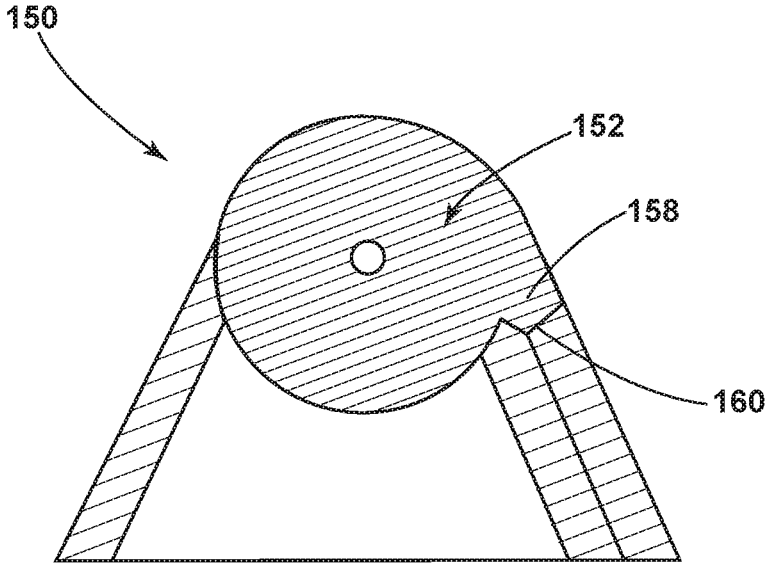
FIG. 5B is a cross-sectional view of the lifter in FIG. 4B in the second position.

FIGS. 5A and 5B illustrate the movement of the adjustable element 152 from the first to the second positions, respectively, with FIG. 5B illustrating the receipt of the ridge 158 within the interior compartment 160. In FIG. 5A the ridge 158 with a rectangular profile defines the maximum height of the lifter 150 when the adjustable element 152 is rotated to the first position. As shown in FIG. 5B, the ridge 158 of the adjustable element 152 is received within an interior compartment 160 of the lifter 150 when the adjustable element 152 is in the second position. In an alternative embodiment, the lifter 150 can be configured to have an interior compartment 160 to accommodate the varying profile of the ridge 158 while still retaining a flush appearance from the exterior when the adjustable element 152 is in the second position.

The ease of adjustability of each lifter height and profile allow the user to adjust the amount of mechanical energy by lifting/dropping, collision and friction imparted to the laundry items as the amount of mechanical energy is related to the height of the lifter. A heavy-duty load can benefit from a lifter 150 setting with a higher protrusion and edged profile to create more friction during a washing cycle. A delicate load can benefit from a lifter 150 setting with a lower protrusion and smoother profile to prevent any damage done to the laundry during a washing cycle. Furthermore, the adjustable element in the second position being one of flush with a sidewall of the lifter or received within an interior of the lifter provide an appearance that is clean and aesthetically pleasing to the consumers.

The lifter 50, while variable in height, can be used alone or in combination with other lifters that are fixed height or variable in height.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Combinations or permutations of features described herein are covered by this disclosure.

Although illustrative embodiments of the present invention have been shown and described, it would be appreciated by those skilled in the art that changes may be made in these illustrative embodiments without departing from the principles and spirit of the invention, the scope of which is defined in the claims and their equivalents.

The invention claimed is:

1. A laundry treating appliance comprising:

a drum having an inner surface at least partially defining a treating chamber and an end with an opening to define an access opening to the treating chamber; and a lifter extending from the inner surface inwardly into the treating chamber and having an adjustable element rotatably mounted to the lifter and rotating between first and second positions, the adjustable element having first and second profiles and a maximum projection;

wherein when the adjustable element is in the first position, the first profile provides the lifter with a first effective height defined by the maximum projection, and when the adjustable element is in the second position, the second profile provides the lifter with a second effective height, which is less than the first effective height, and further wherein the maximum projection is at least one of flush with a sidewall of the lifter or received within an interior of the lifter when the adjustable element is in the second position.

2. The laundry treating appliance of claim 1 the drum rotates about a horizontal axis.

3. The laundry treating appliance of claim 1 further comprising multiple lifters.

4. The laundry treating appliance of claim 3 wherein the multiple lifters are equally spaced about the inner surface of the drum.

5. The laundry treating appliance of claim 1 wherein the adjustable element comprises a main body and a ridge projecting from the main body.

6. The laundry treating appliance of claim 5 wherein the maximum projection comprises the ridge.

7. The laundry treating appliance of claim 5 wherein in the first position, the ridge defines a maximum height of the lifter.

8. The laundry treating appliance of claim 5 wherein in the second position, the ridge lies below a maximum height of the lifter.

9. The laundry treating appliance of claim 1 wherein the adjustable element comprises an asymmetrical body rotatable about a rotation axis.

10. The laundry treating appliance of claim 9 wherein the asymmetrical body defines the maximum projection of the adjustable element radially furthest from the rotation axis.

11. The laundry treating appliance of claim 10 wherein the asymmetrical body further defines a lesser projection radially closer to the rotation axis than the maximum projection, and in the second position the lesser projection defines the second effective height.

12. The laundry treating appliance of claim 1 further comprising a lock fixing the adjustable element in at least one of the first and second positions.

13. The laundry treating appliance of claim 12 wherein the lock comprises an actuator located on the lifter.

14. The laundry treating appliance of claim 13 wherein the actuator is located on an end of the lifter facing the access opening.

15. A laundry treating appliance comprising:

a drum having an inner surface at least partially defining a treating chamber and an end with an opening to define an access opening to the treating chamber; and a lifter extending from the inner surface inwardly into the treating chamber and having an adjustable element rotatably mounted to the lifter and rotating between first and second positions, the adjustable element having a main body and a ridge projecting radially outwardly from the main body;

wherein when the adjustable element is in the first position, the lifter is provided with a first profile having a first effective height defined by the ridge of the adjustable element, and when the adjustable element is in the second position, the lifter is provided with a second profile having a second effective height defined by the main body of the adjustable element, wherein the second effective height is less than the first effective height, and further wherein the ridge is at least one of flush with a sidewall of the lifter or received within an interior of the lifter when the adjustable element is in the second position.

16. The laundry treating appliance of claim 15 wherein the ridge defines a radially outermost maximum projection of the adjustable element.

17. The laundry treating appliance of claim 15 wherein the adjustable element comprises an asymmetrical body rotatable about a rotation axis.

18. The laundry treating appliance of claim 17 wherein the asymmetrical body comprises the ridge defining a maximum projection of the adjustable element radially furthest from the rotation axis.

19. The laundry treating appliance of claim 18 wherein the asymmetrical body comprises the main body defining a lesser projection radially closer to the rotation axis than the maximum projection, and in the second position the lesser projection defines the second effective height.

20. A laundry treating appliance comprising:

a drum having an inner surface at least partially defining a treating chamber and an end with an opening to define an access opening to the treating chamber; and a lifter extending from the inner surface inwardly into the treating chamber and having an adjustable element rotatably mounted to the lifter and rotating about a rotation axis between first and second positions, the adjustable element comprising an asymmetrical body having first and second profiles and a maximum projection;

wherein when the adjustable element is in the first position, the first profile provides the lifter with a first effective height defined by the maximum projection, and when the adjustable element is in the second position, the second profile provides the lifter with a second effective height, which is less than the first effective height, and further wherein the maximum projection is at least one of flush with a sidewall of the lifter or received within an interior of the lifter when the adjustable element is in the second position.

* * * * *